US007090074B2

(12) United States Patent
Isaacs

(10) Patent No.: US 7,090,074 B2
(45) Date of Patent: Aug. 15, 2006

(54) MEMO PAD HOLDER

(75) Inventor: Linda R. F. Isaacs, Far Rockaway, NY (US)

(73) Assignee: Innovative Premiums, Inc., Oceanside, NY (US)

( * ) Notice: Subject to any disclaimer, the term of this patent is extended or adjusted under 35 U.S.C. 154(b) by 70 days.

(21) Appl. No.: 10/409,320

(22) Filed: Apr. 8, 2003

(65) Prior Publication Data

US 2003/0192790 A1 Oct. 16, 2003

Related U.S. Application Data

(60) Provisional application No. 60/371,521, filed on Apr. 10, 2002.

(51) Int. Cl.
*A45C 11/34* (2006.01)
*B65D 85/28* (2006.01)
*B65D 85/48* (2006.01)

(52) U.S. Cl. ..... 206/214; 206/371; 206/449

(58) Field of Classification Search ..... 206/214, 206/215, 37, 38, 39, 39.1, 101, 450, 480, 206/371, 449, 752, 755; 224/269; 312/231; D19/91, 92, 88; 248/452; 220/324, 326, 220/212, 694; 24/457; 40/124.06, 313, 40/658, 647, 358; 281/45
See application file for complete search history.

(56) References Cited

U.S. PATENT DOCUMENTS

| | | | | | |
|---|---|---|---|---|---|
| 2,154,225 | A | * | 4/1939 | Wewetzer | 206/37 |
| 3,302,774 | A | * | 2/1967 | Zalkind | 206/39 |
| 3,977,744 | A | * | 8/1976 | DeWitt | 206/214 |
| D304,784 | S | * | 11/1989 | De Witt | D3/274 |
| 4,896,927 | A | * | 1/1990 | Liu et al. | 312/190 |
| 5,261,122 | A | * | 11/1993 | Otsuki et al. | 224/670 |
| 5,419,013 | A | * | 5/1995 | Hsiao | 16/319 |
| 5,575,399 | A | * | 11/1996 | Intini | 220/835 |
| 5,718,347 | A | * | 2/1998 | Walker et al. | 220/324 |
| 5,845,889 | A | * | 12/1998 | Suzuki | 40/658 |
| 5,915,554 | A | * | 6/1999 | Hung | 206/372 |
| 6,119,851 | A | * | 9/2000 | Paciello | 206/214 |
| 6,405,910 | B1 | * | 6/2002 | Infanti et al. | 224/271 |
| 2001/0000901 | A1 | * | 5/2001 | Kambouris et al. | 220/212 |

* cited by examiner

*Primary Examiner*—Mickey Yu
*Assistant Examiner*—J. Gregory Pickett
(74) *Attorney, Agent, or Firm*—Katten Muchin Roseman LLP

(57) ABSTRACT

A memo pad holder has a base having a storage chamber suitable to receive a memo pad, a cover attached to the base and movable between open and closed positions and a clip disposed on the cover. The clip may be used to hold papers or the like while the cover is in the open and/or closed position.

15 Claims, 6 Drawing Sheets

MEMO PAD HOLDER

CROSS-REFEFERENCE TO RELATED APPLICATION

This application claims priority under 35 U.S.C. §119(e) from U.S. Provisional Application. 60/371,521 filed Apr. 10, 2002.

FIELD OF THE INVENTION

The present invention relates to memo pad holders in general, and more particularly to a memo pad holder having a cover on which is provided a clip for retaining papers and the like.

BACKGROUND OF THE INVENTION

Memo pad holders generally serve a single purpose, namely to hold a memo pad or sundry miscellaneous articles in a storage compartment. Thus, such holders function in a manner not unlike a standard storage box.

Aware of the limitations of a standard storage box, the present inventor has devised an improvement to increase the functionality of a memo pad holder such that items may be held on the cover of such holder in addition to the storage compartment in which a pad or sundry articles are usually held.

SUMMARY OF THE INVENTION

A memo pad holder has a base having a storage chamber suitable to receive a memo pad, a cover attached to the base and movable between open and closed positions and a clip disposed on the cover. The clip may be used to hold papers or the like while the cover is in the open and/or closed position.

DETAILED DESCRIPTION OF THE PREFERRED EMBODIMENTS

Figure 1:
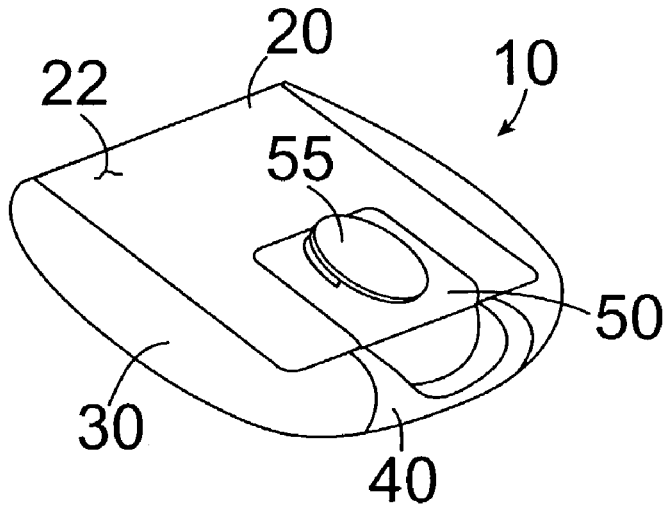
FIG. 1 is a perspective view of the holder of the invention in the closed position.
Figure 2:
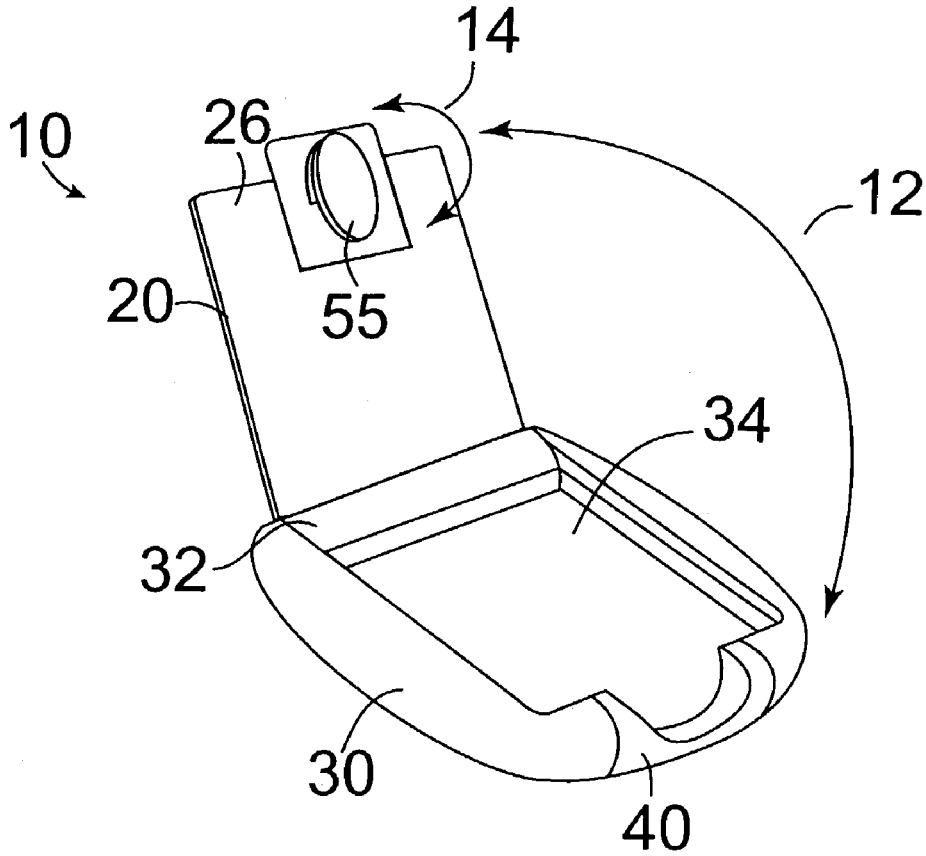
FIG. 2 is the memo pad holder of FIG. 1 in the open position.
Figure 3:
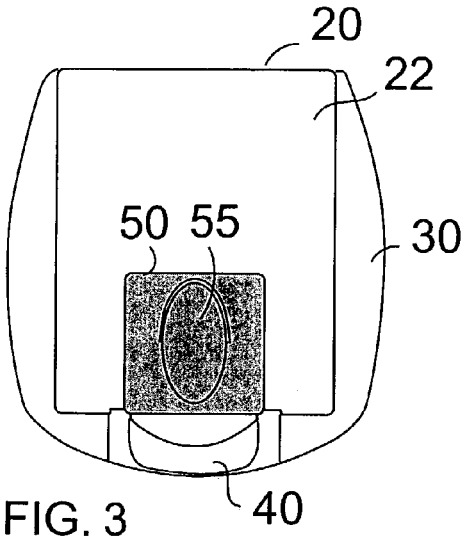
FIG. 3 is a top view of the memo pad holder of FIG. 1.
Figure 4:
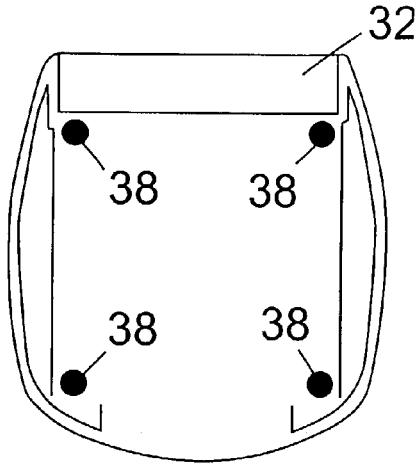
FIG. 4 is a bottom view of the memo pad holder of FIG. 1.
Figure 5:
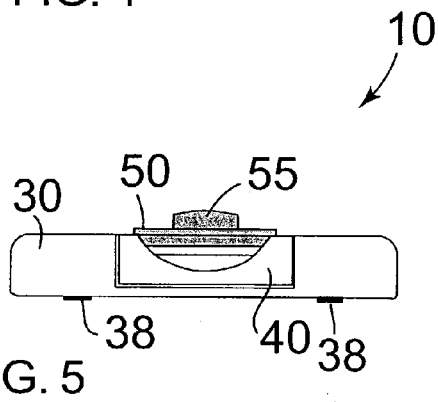
FIG. 5 is a front elevation view of the memo pad holder of FIG. 1.
Figure 6:
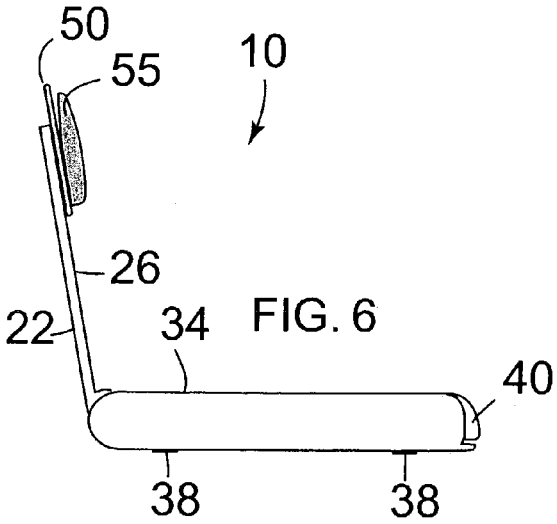
FIG. 6 is a side elevation view of the inventive holder in the open position.
Figure 7:
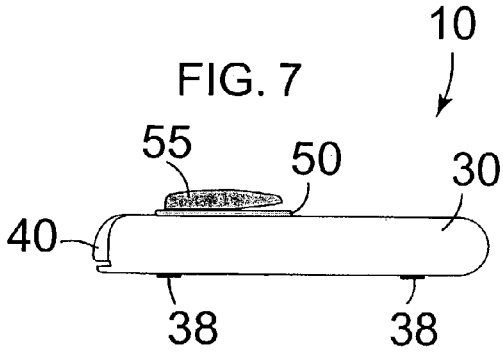
FIG. 7 is a side elevation view of the memo pad holder of FIG. 1.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIGS. 1–8 illustrate one embodiment of a memo pad holder of the present invention. While the holder is being described as a "memo pad" holder, it will be understood that other items may be held in such holder as desired. The memo pad holder 10 has a cover 20, a base 30, an opening mechanism 40 and a clip 50 having a clasp portion 55. The base 30 preferably comprises non-slip pads or feet 38 for engagement with a support surface and to prevent undesired movement of the holder 10 relative to the support surface. The cover 20 has an outside surface 22 and an inside surface 26 and is rotatably pivotable about a hydraulic hinge 32 from an open position (FIG. 1) to a closed position (FIG. 2) along a path of movement illustrated by arrow 12. The cover 20 is latched to the base 30 such that pressing down on the opening mechanism 40 releases the cover 20 from the base 30 and results in the cover 20 swinging from the closed to the open position, thereby revealing a storage chamber 34 for the reception of a memo pad or other various articles. The storage chamber 34 may be particularly dimensioned to hold a pad of the Post-It® variety, or it could be sized to hold other sizes or types of product as desired.

Figure 8:
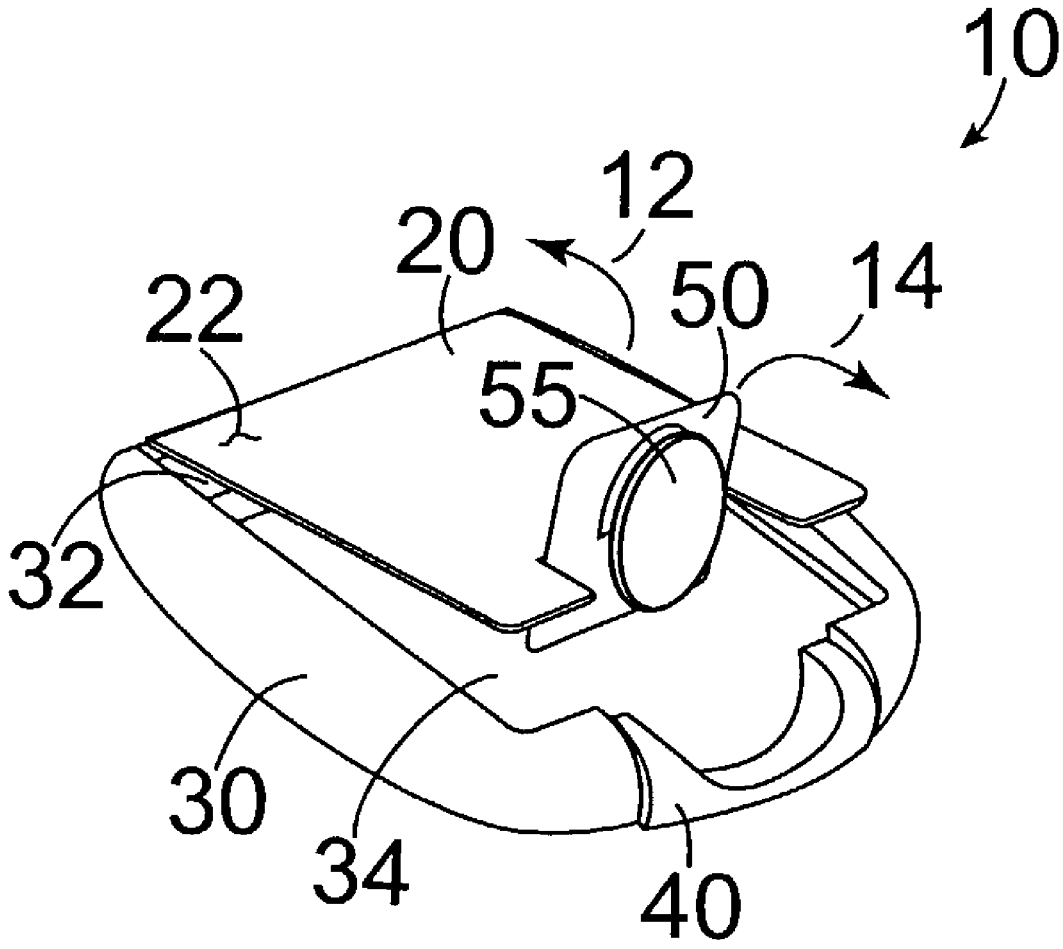
FIGS. 8–10 are perspective views of the holder of the invention with the cover partially open and with the clip in various positions relative to the cover.
Figure 9:
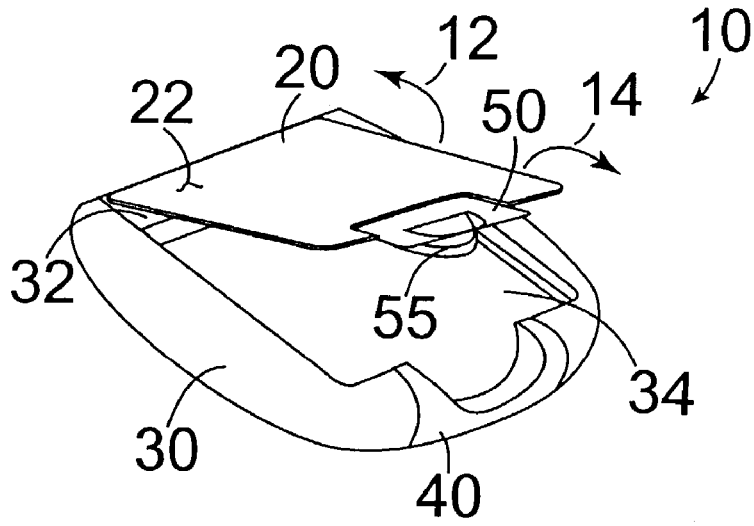
Figure 10:
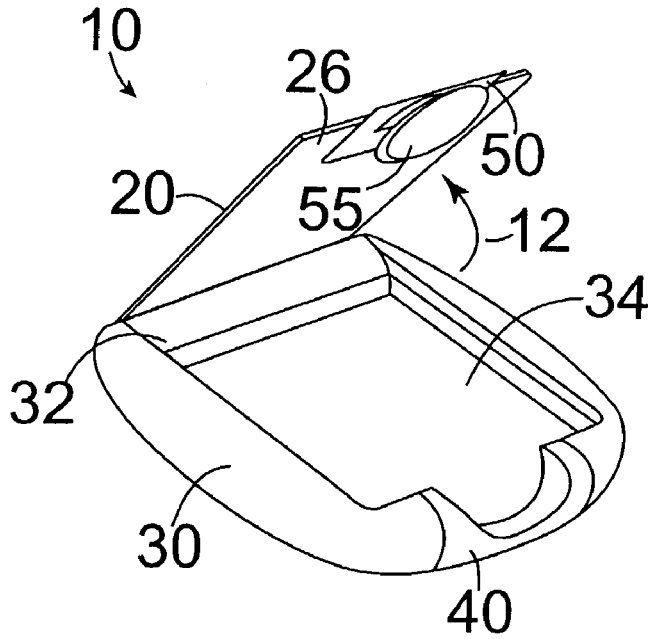
Figure 11:
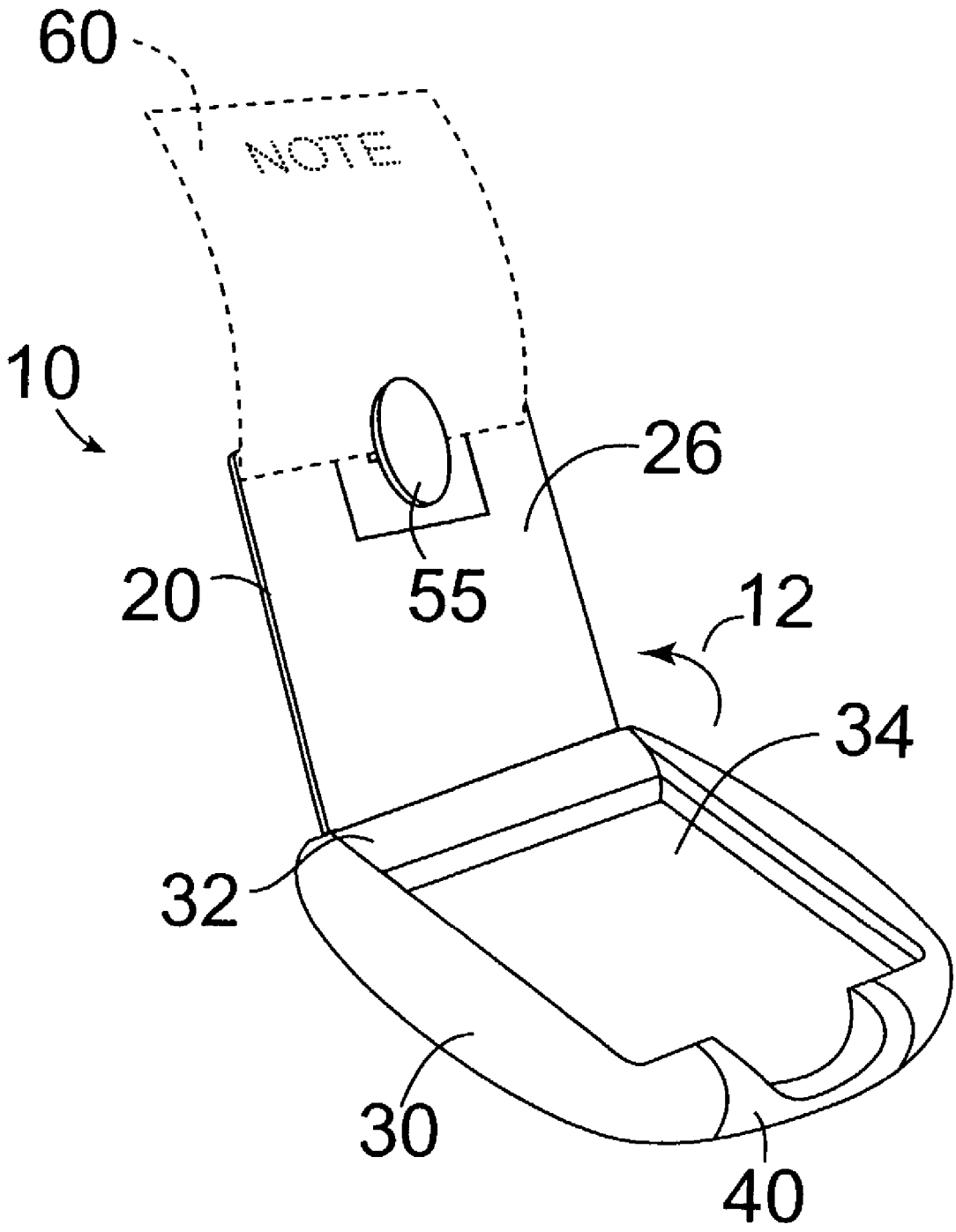
FIG. 11 is a perspective view of the of the memo pad holder of the invention in the open position and holding a note.
Figure 13:
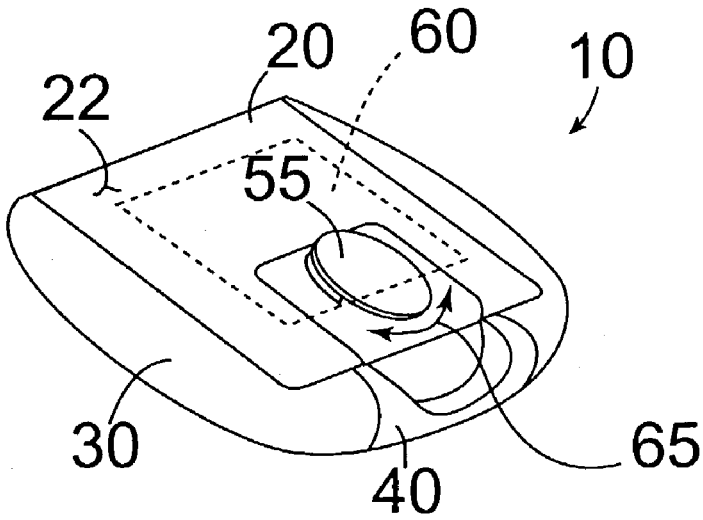
FIG. 13 is a perspective view of the memo pad holder of the invention in the closed position and holding a note.

The clip 50 can be removably positioned with respect to the cover 20 so that the clasp portion 55 can be arranged on the outside surface 22 or the inside surface 26 of the cover 20. For example, the inside and outside surfaces 26, 22 of the cover 20 can be fitted with grooves in which the clip 50 slides and is releasably retained. Alternatively, the clip 50 may be pivotally attached to the cover 20 so that it is rotatable from a first position adjacent the outside surface 22 to a second position adjacent the inside surface 26 as shown in FIGS. 8–10. Thus, when the pad holder 10 is in the closed position, the clasp portion 55 may be located along the outside surface 22 of the cover 20 so as to be used to hold a sheet of paper, card or the like 60 (FIG. 13). However, in the open position (FIGS. 2 and 11), the clip 50 may be moved (see movement arrow 14) so that the clasp portion 55 is located on the inside surface 26 to hold various articles 60 as desired (FIG. 11). Thus, the clasp portion 55 may be used while the memo pad holder 10 is in the open or closed positions. FIGS. 8–10 illustrate one method of operating the memo pad holder of the present invention, wherein the clip 50 starts to automatically rotate away from the outer surface 22 of the cover 20 upon activation of the opening mechanism 40 (FIG. 8), and then continues to flip all the way around so as to be adjacent the inner surface 26 of the cover 20 (FIG. 9 to FIG. 10) when the cover 20 is fully opened. Of course, rotation of the clip 50 relative to the cover 20 as illustrated in FIGS. 8–10 can occur manually as described herein.

Figure 12:
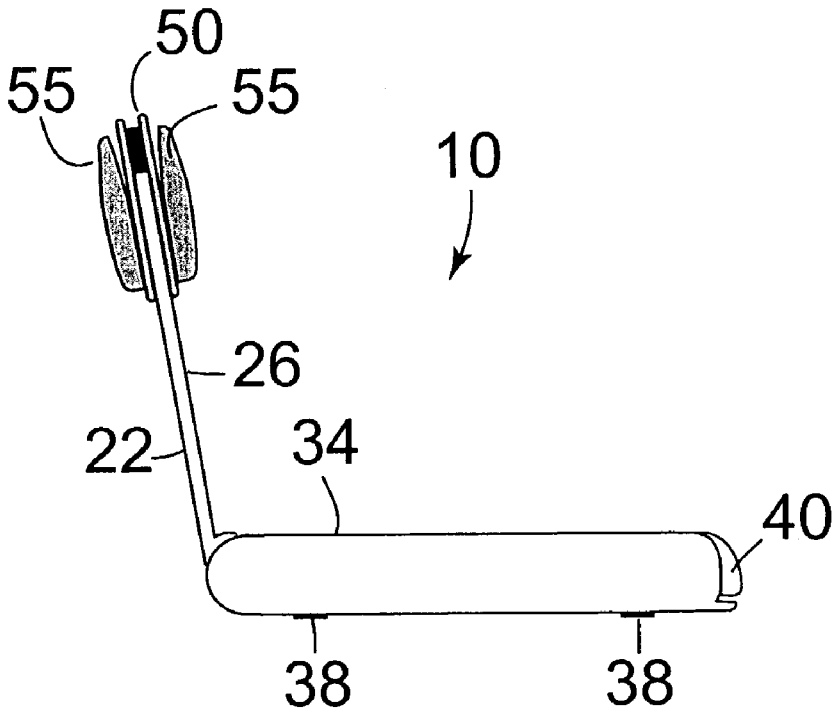
FIG. 12 is a side elevation view of an alternative embodiment of the memo pad holder of the invention.

As noted above, the clip 50 may be attached to the cover 20 by various means. The clip 50 could also be attachable to both the inside and outside surfaces 26, 22 of the cover 20 separately, or jointly by straddling both surfaces in the nature of a paper clip attachment to a piece of paper. In other words, the clip 50 could be clamped onto an edge of the cover 20 and be provided with two clasps 55, one clasp 55 positioned adjacent the outer surface 22 and one clasp 55 positioned adjacent the inner surface 26 as shown in FIG. 12.

The clip could also be arranged so that a clasp portion 55 is provided on both the inside and outside surfaces 26, 22 of the cover at the same time, with each clasp portion 55 being rotatable with respect to such surfaces into an orientation suitable for holding articles while the memo pad holder is in the open or closed position. For instance, if the memo pad holder is in the closed position, a clasp portion 55 provided on the outside surface 22 (FIG. 13) might be rotated along rotation arrow 65 so that a piece of paper or the like 60 being held by such clasp portion 55 rests along the cover 20. Similarly, if the memo pad holder is in the open position, the clasp holder 55 might be rotated so that a piece of paper or the like 60 can be held outward (see FIGS. 6 and 11) with respect to the cover 20.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

For instance, the memo holder can be molded into various geometric shapes or to resemble a particular product or product logo. It can also be formed from a variety or materials and colors. In addition, various actuating mechanisms can be employed for opening and closing the cover relative to the base. Furthermore, the clip and clasp portion may be arranged differently with respect to the pad holder, such that the clip is not necessarily positioned adjacent the opening mechanism as shown, or it may have a different appearance.

I claim:

1. A memo pad holder comprising:

a base having a storage chamber suitable to receive a memo pad, a cover attached to said base and movable between a closed position covering said storage chamber and an open position exposing said storage chamber; said cover having an inner surface and an outer surface; and a paper holder pivotally attached to said cover for holding a sheet of said memo pad; said paper holder being automatically rotatably movable relative to said cover between said inner and outer surfaces when said cover is moved from the closed position to the open position.

2. A memo pad holder in accordance with claim 1, wherein said base further comprises a hydraulic base hinge and said cover is rotatably pivotable about said base hinge.

3. A memo pad holder in accordance with claim 1, wherein said cover is spring biased toward the open position.

4. A memo pad holder in accordance with claim 3, where said base further comprises an opening mechanism that, when pressed, causes said cover to move from the closed position to the open position.

5. A memo pad holder in accordance with claim 1, where said base further comprises an opening mechanism that, when pressed, causes said cover to move from the closed position to the open position.

6. A memo pad holder in accordance with claim 1, wherein said base has an opening mechanism, and wherein said paper holder is disposed adjacent said opening mechanism.

7. A memo pad holder in accordance with claim 1, wherein said paper holder is rotatable relative to said cover about a second axis.

8. A memo pad holder in accordance with claim 1, wherein said paper holder is accessible to a user when said cover is an said open and closed positions.

9. A memo pad holder in accordance with claim 1, wherein said paper holder is positioned relative to said cover such that when said cover is in the open position, an item held by said paper holder would be oriented away from said base.

10. A memo pad holder in accordance with claim 1, wherein said paper holder is positioned relative to said cover such ihat when said cover is in the open position, an item held by said paper holder would be oriented toward said base.

11. A memo pad holder in accordance with claim 1, wherein said paper holder is positioned relative to said cover such that when said cover is in the closed position, an item held by said paper holder would be oriented along said outer surface and parallel thereto.

12. A memo pad holder in accordance with claim 1, wherein said base has friction-reducing non-slip pads disposed on a bottom surface thereof.

13. A memo pad holder comprising:

a base having a storage chamber suitable to receive a memo pad;

a cover attached to said base and movable between a closed position covering said storage chamber and an open position exposing said storage chamber, said cover having an inner surface and an outer surface; and a paper holder rotatably disposed along an axis on said cover for holding a sheet of said memo pad; said paper holder being automatically rotatable relative to said cover between said inner and outer surfaces along said axis when said cover is moved from the closed position to the open position.

14. A memo pad holder in accordance with claim 13, wherein said paper holder is disposed on one of said inner and outer surfaces.

15. A memo pad holder in accordance with claim 13, wherein said paper holder is removable from said cover.

* * * * *